United States Patent [19]

Coaton et al.

[11] Patent Number: 4,507,584

[45] Date of Patent: Mar. 26, 1985

[54] DISCHARGE LAMP WITH METAL COIL ELECTRODE SUPPORT INSERTED INTO CERMET END CAP

[75] Inventors: James R. Coaton, Groby; Douglas Hussey, Coventry, both of England

[73] Assignee: Thorn EMI plc, London, England

[21] Appl. No.: 417,653

[22] Filed: Sep. 13, 1982

[30] Foreign Application Priority Data

Sep. 15, 1981 [GB] United Kingdom ..... 8127747

[51] Int. Cl.[3] ..... H01J 61/36; H01J 9/32

[52] U.S. Cl. ..... 313/624; 313/623; 313/625; 313/281

[58] Field of Search ..... 313/624, 625, 623, 285, 313/281, 289, 634

[56] References Cited

U.S. PATENT DOCUMENTS 4,401,913 8/1983 Koza et al. ..... 313/634 X

FOREIGN PATENT DOCUMENTS 50-32550 10/1975 Japan ..... 313/625
565689 11/1944 United Kingdom .
1005809 9/1965 United Kingdom .
2036420 6/1980 United Kingdom ..... 313/623

*Primary Examiner*—David K. Moore
*Assistant Examiner*—Vincent DeLuca
*Attorney, Agent, or Firm*—Fleit, Jacobson, Cohn & Price

[57] ABSTRACT

High pressure discharge lamps have discharge tubes of ceramic material having end caps into which electrodes are mounted on fixed shanks. The invention provides a preferred construction for mounting on electrode shank or an external conducting member in a cermet end cap. A metal coil is fixed in a respective opening in the end cap and supports the respective shank or conductor therein. Preferably the cermet is pressed into the desired shape with an aperture in it. The coil is inserted into the aperture so that after sintering the coil is fixed into the sintered cermet.

12 Claims, 4 Drawing Figures

DISCHARGE LAMP WITH METAL COIL ELECTRODE SUPPORT INSERTED INTO CERMET END CAP

The present invention relates to a high pressure discharge lamp having a discharge tube of ceramic material with end caps at the ends thereof and an electrode mounted on a fixed shank in the cap at each end. In particular the invention relates to the mounting of the electrode shanks in the end caps or to the mounting of external connections to the end caps or both.

The invention finds particular application in high pressure sodium discharge lamps including at least sodium and mercury.

The development of practical high pressure sodium lamps was facilitated by the development of polycrystalline alumina ceramic (PCA) discharge tubes and appropriate methods of sealing the electrodes into the ends of the tubes.

One favoured method of closing the ends of the discharge tube involves an end cap made of a cermet (ceramic-metal). The cermet may be either conducting or non-conducting. For non-conducting cermets the electrode shank on which the electrode is mounted, or at the end of which it is formed, may pass right through and be sealed in the end cap or may be mounted on a suitable conducting member which passes through the cap. In the interests of better or more convenient sealing, however, a conducting cermet may be used with the electrode shank and external connections buried and fixed in the inside and outside respectively but not passing right through.

There are, however, practical problems involved in inserting and fixing the refractory metal rods of the electrode shanks into the cermet end caps.

In the first place the difference in thermal expansion between the rods and the cermet caps can cause cracking in the cermet, particularly in the "boss" area surrounding the electrode shank. Also certain metals, such as undoped molybdenum, will undergo recrystallisation during the cermet sintering process, so that the rod is left in a brittle state. This may be overcome by using doped molybdenum or Aluminium Potassium Silicon doped (AKS) tungsten for the rods but the latter may give more severe cracking problems.

The method which we have preferred hitherto for assembling high pressure sodium lamp electrodes of a known type having a coil, perhaps overwound, on an electrode shank for use with end closures other than cermet caps, comprises fixing the coil portion to the shank, impregnating the coil with an electron emitter, vacuum furnacing and finally removal of any excess emitter. The fully processed electrode assembly is then attached to the current carrying leadthrough arrangement. At present in discharge tubes having cermet end caps the electrode shank is sintered into the cap. This means that the emitter impregnated coil must be attached afterwards. Such a procedure complicates the processing since the impregnated coil must have excess emitter removed from both the inside and outside surfaces to facilitate threading onto the shank. Furthermore it is difficult to weld the emitter coated coil to the shank because of variable electrical contact resistance through the emitter.

It is an object of this invention to provide a method, of fixing the electrode shank to the end cap, which goes at least some way towards removing these disadvantages and a cap assembly suitable for use with that method.

According to the present invention there is provided an end closure cap for a high pressure discharge lamp, the cap being made of a conductive cermet and having, fixed in a respective opening therein, at least one metal coil to receive and support a refractory metal rod forming part of an electrode assembly or a metal rod forming part of an external connection thereto.

The invention also embraces such an end closure cap having an electrode assembly fixed thereon and a discharge tube assembly and high pressure discharge lamp including one or more such caps.

According to a further aspect of the invention there is provided a method of constructing an end closure cap for a high pressure discharge lamp, the method comprising: pressing a conductive cermet powder, into a desired shape, having an aperture in at least one end thereof, to approximately 50% of the desired final density; inserting a metal coil into said aperture; and sintering the cermet with the coil inserted therein to attain its final density and to fix the coil therein.

According to yet a further aspect of the invention there is provided a method of assembling a discharge tube assembly for high pressure discharge lamp the method including mounting and supporting an electrode shank in a conductive cermet end cap by means of a coil support prefixed into an aperture in the end cap.

In British Patent No. 1,005,809 there is described a mercury vapor discharge lamp having a quartz envelope in which electrical conduction is by a conventional molybdenum foil pinch seal. A helical coil electrode shield is provided in one example and in FIG. 5 this is fixed by extending the coil into the pinch around the electrode shank. There is, however, no suggestion of using this to fix the shank in the envelope and with the pinch seal it would be redundant. Such an arrangement provides no teaching for the fixing of an electrode shank into a conducting cermet end cap of a high pressure discharge lamp arc tube.

In order that the invention may be clearly understood and readily carried into effect it will now be described with reference to the accompanying drawings of which:

Figure 1:
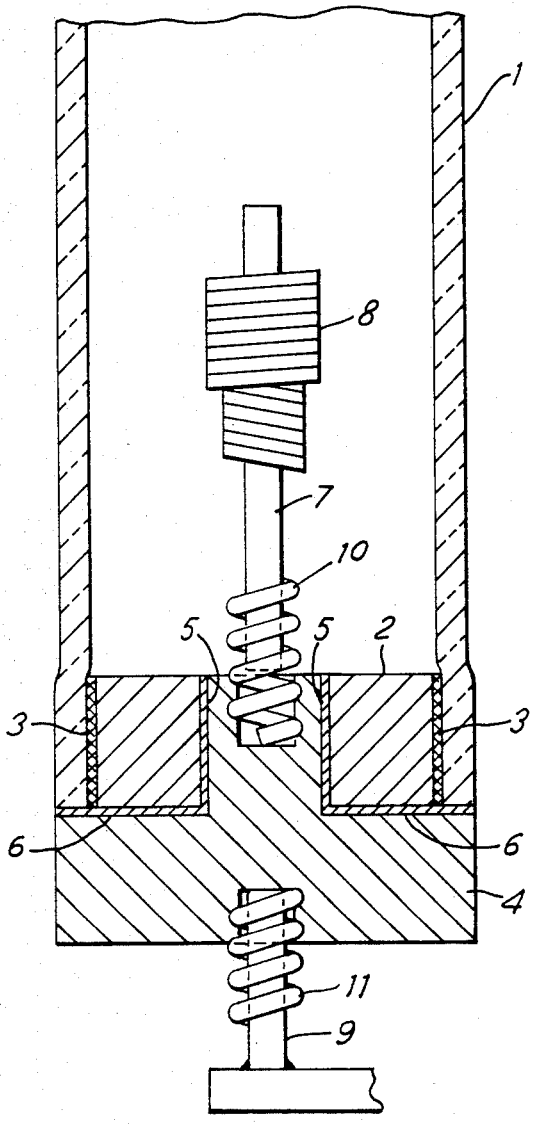
FIG. 1 shows in part section one end of a discharge tube having an electrode shank and external lead fixed to the end cap by use of the invention.

In FIG. 1 there is shown in section one end of a high pressure sodium lamp discharge tube assembly comprising a discharge tube 1 with an electrode assembly mounted in an end closure therein. The discharge tube 1 is made of densely sintered polycrystalline alumina. Sealed into the envelope is an end plug 2, which is in this example also of polycrystalline alumina and is sintered at 3 to the envelope 1. The end plug 2 is in this example annular, having a large central aperture.

An additional closure member in the form of a cermet and cap 4 of a generally "top hat" shape is sealed within the aperture in the end plug 2 and also to the outer face of the end plug 2 and to the end of the envelope 1. The sealing is achieved by a suitable sealing material at surfaces 5 and 6.

Within the discharge tube there is mounted a shank 7 supporting an electrode coil 8, being in this example a conventional overwound coil carrying electron emissive material in a well known manner to support the discharge.

Since the cermet end cap is a conductive cermet the electrode 7 does not pass through the cap and a wire lead-in 9 is fixed in the outer face.

In accordance with this invention the shank 7 is fixed in an advantageous manner.

For this fixing a coil 10 is provided part embedded into the cermet cap 4 and part protruding from the cap. The coil acts as a socket to accept the electrode assembly of shank 7 and coil 8, which is fixed therein by suitable means such as welding or hot pressing. This is done before the electrode assembly and end cap are inserted together into the discharge tube. As illustrated the lead in 9 is fixed in a similar manner with a coil 11 although that is not as advantageous as for the electrode shank.

Figure 2:
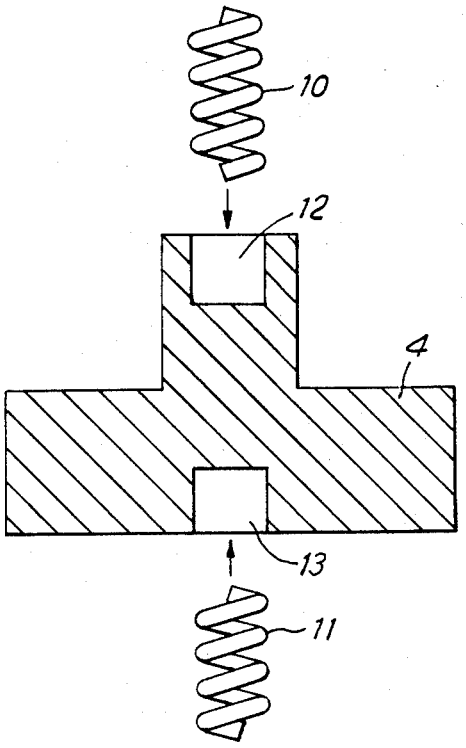
FIG. 2 illustrates the construction of the cermet end cap of the invention.

FIG. 2, which is not to the same scale as FIG. 1, illustrates the assembly of coils 10 and 11 into the end cap 4. The cap 4 is prepared by pressing a cermet powder in a die to about 50% theoretical final density, with holes 12 and 13 being left therein. After pressing the spiral coils 10 and 11 are inserted into holes 12 and 13. The assembly is then sintered using the conventional sintering process whereupon the pre-formed shape shrinks further, resulting in the coils being firmly held within the cermet.

During the sintering process the coil can deform, and this reduces the risk of excessive strain and consequent cracking. The coil, being of conductive material and being uniform and in intimate contact with the cermet shrunk onto it and in good contact with the electrode shank, acts as a current carrying member. Thus it provides good electrical as well as mechanical contact between the end cap and the electrode shank or similarly between the end cap and the external lead in.

It is an additional advantage that the coil socket can be made of any material compatible with the local temperature and environment and need not be made of the preferred material for the electrode shank (AKS tungsten). For example the coil can be of doped molybdenum or thoriated tungsten, both of which remain ductile after the sintering. However AKS tungsten may be the most convenient material and as a coil is less likely to crank than as a rod.

For use of the coiled socket of the invention with the external connection the small amount of flexibility in the coiled lead assists in mounting the completed arc tube onto its supporting frame. It also improves the complete assembly's resistance to shock and vibration. The outer coil sockets such as 11 may also be used to accept directly a portion of the wire frame which conventionally supports the discharge tube, simplifying the mounting operation.

The rods comprising the electrode shank and external connection need not necessarily extend into the portion of the coil held in the cermet cap 4, as is shown for coil 11 and external connection 9. In fact if the coil has partially collapsed or perhaps reduced in size during sintering it may be difficult to insert a rod unless the rod is specifically chosen with a smaller diameter. Not fully inserting the rod, in the manner shown for electrode shank 7 and coil 10 is an acceptable alternative with the additional advantage of providing a degree of flexibility of the join.

It will be appreciated that although the Figures show only one end of the discharge tube 1 it would normally be expected that an electrode assembly or outer leads or both would be mounted at the other end, not shown, in the same way.

The invention is not limited to high pressure sodium lamps being suitable for use with any high pressure discharge lamp employing a ceramic or sapphire (substantially single crystal) arc tube, including for example metal-halide discharge lamps employing ceramic or sapphire arc tubes.

Furthermore the invention is not limited to the precise arrangement illustrated. For example, it may be used with an arrangement having a one piece end closure rather than the two part end plug and cap illustrated.

Figure 3:
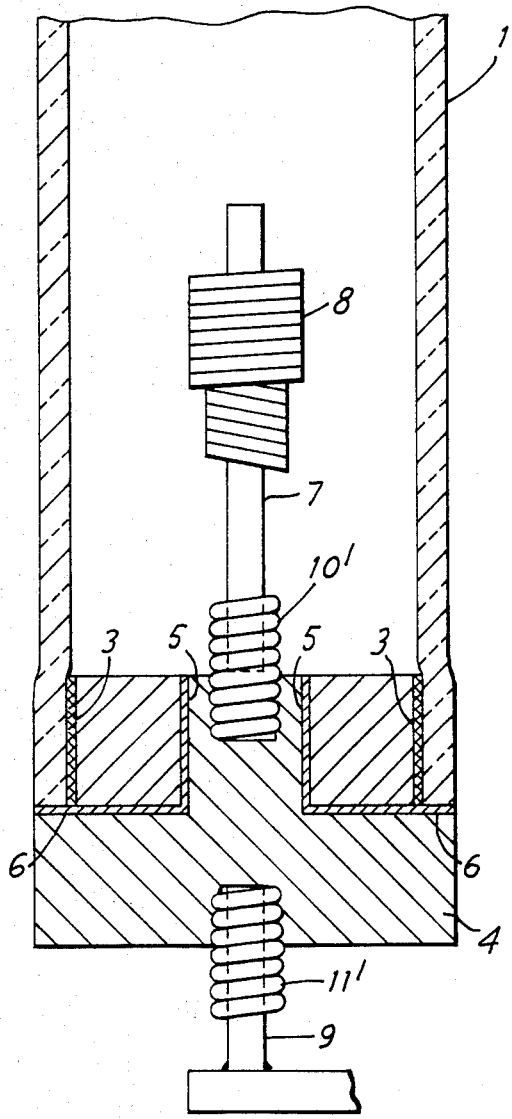
FIG. 3 shows an alternative construction to FIG. 1.

The coils need not be as open as shown in FIGS. 1 and 2 and FIG. 3 shows an arrangement as for FIG. 1 except that coils 10 and 11 have been replaced by completely closed coils 10′ and 11′.

If desired, the inner surface of the cermet plug may have an electrically insulating layer, for example, a suitably shaped alumina washer, covering the conducting surface.

Figure 4:
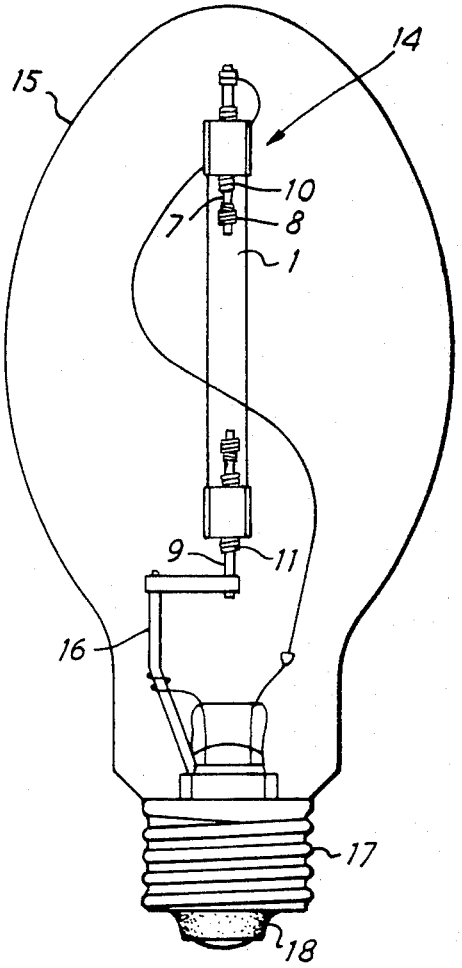
FIG. 4 shows a high pressure discharge lamp embodying the invention.

FIG. 4 shows a high pressure discharge lamp including a discharge tube assembly 14 having end caps in which the electrode shanks 7 and external leads are mounted in the manner of this invention. The assembly is filled with a filling including a vapour producing alkali metal, in this case an amalgam of mercury and sodium and also with xenon in a manner well known for high pressure sodium lamps. The assembly 14 is mounted in an outer envelope 15 being supported therein by a conventional metal framework 16. A conventional lamp base 17 is provided with a terminal 18.

Although the invention has been described in terms of a cermet end cap, for which it is especially beneficial, it is not in principle limited thereto and may be used with end caps of other materials suitable for the lamp and for the invention, where these are available.

Other embodiments of the invention will be apparent to those skilled in the art.

What we claim is:

1. A method of constructing an end closure cap for a high pressure discharge lamp, the method comprising: pressing a conductive cermet powder into a desired shape, having an aperture in at least one end thereof, to approximately 50% of a desired final density; inserting a metal coil into said aperture; and sintering the cermet with the coil inserted therein to attain said desired final density and to fix the coil therein.

2. A method of assembling a discharge tube assembly for a high pressure discharge lamp, the method including mounting and supporting an electrode shank in a conductive cermet end cap by means of a support in the form of a refractory metal coil prefixed by being sintered into the end cap.

3. A method of assembling a discharge tube assembly in accordance with claim 2 wherein the cermet has an aperture formed therein, the metal coil is positioned in the aperture prior to sintering.

4. A discharge tube assembly for a high pressure discharge lamp, the assembly including:

a discharge arc tube made of ceramic material;

at least one end closure member made of an electrically conductive cermet, sealed in a gas-tight manner in a respective end of the arc tube and having an aperture extending part way only therein;

an electrode including an electrode shank in the form of a rod of refractory electrically conductive material;

and metal coil having a first end and a second end forming an electrode support member wherein the metal coil is in part sintered at said first end into said aperture and said second end forms a socket into which said shank is inserted to be held and supported thereby.

5. A discharge tube assembly according to claim 4 in which the metal coil is made of doped molybdenum.

6. A discharge tube assembly according to claim 4 in which the metal coil is made of thoriated tungsten.

7. A discharge tube assembly according to claim 4 in which the metal coil is made of AKS tungsten.

8. A discharge tube assembly according to claim 4 including an external conductive member, a further metal coil forming a further support member embedded in a furher aperture extending part way into a surface of the end closure member external to the arc tube to form a socket into which the external conductive member is inserted to be held and supported thereby.

9. An end closure assembly for the discharge arc tube of a high pressure discharge lamp, the assembly including:

an end closure cap member made of a conductive cermet adapted to close and end of said discharge arc tube and having at least one aperture extending part way therein;

a metal coil having a first end and a second end wherein said first end is embedded in said aperture and said second end protrudes from the cap member to form a socket; and a refractory metal rod held in said socket and supported thereby.

10. A high pressure discharge lamp including an assembly according to claim 9.

11. A discharge arc tube assembly for a high pressure discharge lamp, the assembly including:

a discharge arc tube of a ceramic material ;

an electrode having a shank support;

an electrical lead in member sealed in a gas tight manner within the arc tube and comprising an electrically conductive cermet member having an inner end adjacent to and connected to said electrode and an outer end remote from said electrode;

an internal conductive member part way embedded in said inner end of said cermet member; and an external conductive member part way embedded in said outer end of said cermet member;

wherein said internal conductive member comprises a resilient coil of refractory material forming a socket support for said electrode shank connecting said electrode shank to said lead in member.

12. A discharge arc tube according to claim 11 wherein the external conductive member comprises a further resilient coil of refractory material forming a socket support and a conductor located therein.

* * * * *